US005734228A

United States Patent [19]

Kwon et al.

[11] Patent Number: 5,734,228

[45] Date of Patent: Mar. 31, 1998

[54] PLASMA DISPLAY PANEL FOR MULTI-SCREEN

[75] Inventors: Yang Ho Kwon, Chonju-Shi; Bon Hee Ku, Gumi-Shi, both of Rep. of Korea

[73] Assignee: Orion Electric Co., Ltd., Kyungsangbuk-do, Rep. of Korea

[21] Appl. No.: 525,585

[22] PCT Filed: Dec. 31, 1994

[86] PCT No.: PCT/KR94/00188

§ 371 Date: Sep. 19, 1995

§ 102(e) Date: Sep. 19, 1995

[87] PCT Pub. No.: WO95/20240

PCT Pub. Date: Jul. 27, 1995

[30] Foreign Application Priority Data

Jan. 20, 1994 [KR] Rep. of Korea ..... 1994/1091

[51] Int. Cl.[6] ..... H01J 17/49

[52] U.S. Cl. ..... 313/582; 313/584; 313/586

[58] Field of Search ..... 313/582, 586, 313/584, 484, 1, 2.1; 445/24, 25; 315/169.4

[56] References Cited

U.S. PATENT DOCUMENTS 5,182,489 1/1993 Sano ..... 313/584

FOREIGN PATENT DOCUMENTS

59/52547 4/1984 Japan .
59/110946 7/1984 Japan .
5094774 4/1993 Japan ..... 313/582

*Primary Examiner*—Sandra L. O'Shea
*Assistant Examiner*—Vip Patel
*Attorney, Agent, or Firm*—Dilworth & Barrese

[57] ABSTRACT

A plasma display panel for a multi-screen having a bonding portion disposed within a display area provided by upper and lower plates, the bonding portion being constituted by thin side wall members and a thin bonding member to have a minimized width. Where a multi-screen is fabricated using plasma display panels including the bonding portion, it is possible to minimize generation of mosaic pattern, thereby avoiding any picture distortion phenomenon.

9 Claims, 2 Drawing Sheets

PLASMA DISPLAY PANEL FOR MULTI-SCREEN

TECHNICAL FIELD

The present invention relates to a plasma display panel for a multi-screen constituted by a plurality of unit plasma display panels assembled together, and more particularly to a plasma display panel for a multi-screen capable of minimizing the generation of a mosaic pattern and a picture distortion on the entire multi-screen by minimizing the size of a connection boundary area formed between adjacent unit plasma display panels connected to each other to constitute the multi-screen.

BACKGROUND ART

To manufacture an image display device with a large screen having a size of several hundred inches, a multi-screen system is generally used, in which a screen is constituted by connecting a plurality of unit display devices together such that adjacent unit displays are in contact with each other at their facing edges. This is because it is difficult to fabricate a large screen using a single display device in terms of technology and economy.

Where a large screen is fabricated using plasma display panels, it is suitable to use the multi-screen system because of the above-mentioned reason. Plasma display panels have a superior non-linearity over other planar displays. Where these plasma display panels are used to constitute a multi-screen, accordingly, they can exhibit a continuity between adjacent unit screens, thereby providing a screen with good quality as compared to other display devices.

Even in the multi-screen constituted by the plasma display panels, however, it is difficult to avoid a connection boundary area formed between adjacent unit plasma display panels each constituting a partial screen. As a result, a mosaic pattern is formed on the entire screen. The reason why the connection boundary area is formed is because each unit plasma display panel has a non-display area at its sealing portion for bonding upper and lower plates of the unit plasma display panel due to a certain thickness of the sealing portion. Since the thickness of the sealing portion is increased twice when adjacent unit plasma display panels are connected to each other, a connection boundary area disabling a display on the screen is formed at the connection region between adjacent unit plasma display panels.

In spite of the non-linearity characteristic of plasma display panels, the mosaic pattern causes a picture distortion phenomenon to occur upon connecting pictures. As a result, the entire picture becomes unnatural, thereby resulting in a degradation in picture quality. In particular, where an oblique line is displayed such that it extends over adjacent outermost display cells of adjacent unit plasma display panels, its display becomes inaccurate because a picture distortion occurs due to the thickness of the connection boundary area, in spite of the superior non-linearity characteristic of the plasma display panels.

It is apparent that such a mosaic pattern generated due to the connection boundary area serves to degrade the quality of the entire screen. It is therefore desirable to prevent the generation of such a mosaic pattern as much as possible. In order to minimize the picture distortion occurring due to the connection boundary area, it is required to reduce the width of the connection boundary area. For this, there has been proposed a method for bonding upper and lower plates of each unit plasma display panel at their edges using a bonding glass plate. However, this method is difficult to efficiently accomplish the purpose for eliminating or reducing the connection boundary area. This is because the bonding glass plate should have a certain thickness to provide reliability and workability.

Another method has also been proposed which involves attaching a bonding member along side edges of the upper and lower plates and then pressing the bonding member to reduce the thickness of the bonding member. In this method, however, the bonding member should also have a certain thickness on the outside of the upper and lower plates. In other words, it is difficult to efficiently reduce the connection boundary area by using this method.

Therefore, an object of the invention is to provide a unit plasma display panel capable of minimizing the size of a connection boundary area formed between adjacent unit plasma display panels connected to each other to constitute a multi-screen, thereby minimizing the generation of a mosaic pattern on the entire multi-screen.

DISCLOSURE OF THE INVENTION

In accordance with the present invention, this object is accomplished by providing a plasma display panel for a multi-screen comprising: an upper plate and a lower plate; a plurality of cathode electrodes and anode electrodes arranged so that they are spaced facing each other between the upper and lower plates; a plurality of inner display cells defined within a display area provided between the upper and lower plates by a plurality of spaced first partition members arranged between the upper and lower plates, respectively, the inner display cells having the same area; outermost display cells arranged along edges of the upper and lower plates, each of the outermost display cells being defined between side wall means provided along the edges of the upper and lower plates and a second partition member arranged between the upper and lower plates and spaced from the side wall means inwardly of the upper and lower plates, the second partition member having a reduced thickness over that of each first partition member; and bonding means arranged outwardly of the side wall means and provided with an outer surface vertically aligned with the edges of the upper and lower plates, the bonding means being adapted to bond the upper and lower plates to each other.

In accordance with a preferred embodiment of the present invention, the bonding means forming an outer boundary area of each outermost display cell is arranged within the outermost display cell without being arranged outwardly of the display area. Preferably, each of the outermost display cells has a size smaller than the size of each inner display cell by a size almost identical to the size of the bonding means. Where a multi-screen is constituted by connecting a plurality of unit plasma display panels together such that adjacent unit plasma display panels are in contact with each other at their facing edges, accordingly, it is possible to avoid any picture distortion phenomenon between adjacent unit plasma display panels. It is also possible to minimize generation of a connection boundary area.

In accordance with another embodiment of the present invention, the second partition member isolating each outermost display cell from display cells adjacent thereto is reduced in width at its portion facing the outermost display cell to partially compensate the reduced size of the outermost display cell. With such a construction, it is possible to partially compensate the discharge area of the outermost display cell reduced due to the bonding means arranged within the outermost display cell.

BRIEF DESCRIPTION OF DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
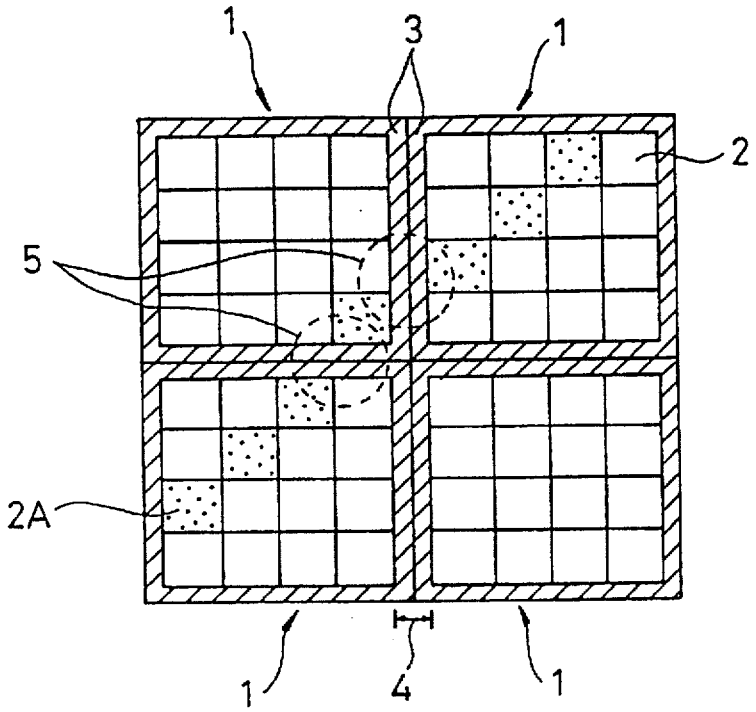
FIG. 1 (PRIOR ART)
FIG. 1 is a plan view schematically illustrating a multi-screen constituted by conventional plasma display panels.

FIG. 1 is a schematic view illustrating a multi-screen constituted by conventional plasma display panels. As shown in FIG. 1, each of the unit plasma display panels 1 includes a bonding member 3 for bonding the upper and lower plates to each other. The bonding member 3 extends along outer edges of outermost display cells 2 thereof, that is, edges of upper and lower plates. Although not shown, the upper plate of each unit plasma display panel 1 generally has an area larger than that of the lower plate. In other words, the upper plate extends outwardly beyond the lower plate. The bonding member 3 is disposed between the end of the lower plate and the portion of the upper plate extending beyond the end of the lower plate, to firmly fix the edges of the upper and lower plates. Due to the provision of this bonding member 3, the portion of the upper plate extending beyond the lower plate is left as a margin area where any display function is not performed at all. Such a margin area does not interfere with the display function of the screen where the screen is constituted by only one plasma display panel. Where a multi-screen is constituted by connecting a plurality of unit plasma display panels 1 together such that adjacent unit plasma display panels are in contact with each other at their facing edges as shown in FIG. 1, however, the above-mentioned problem is generated because a connection boundary area is formed on the entire screen due to the margin area. For example, when an oblique line is displayed on the multi-screen shown in FIG. 1, it has no continuity due to the thickness of the connection boundary area formed due to the bonding member 3, as indicated by the circles 5 in FIG. 1. As a result, the picture quality is degraded.

Another conventional method has also been proposed, wherein upper and lower plates having the same size are used. In accordance with this method, the bonding member 3 has an outer surface vertically aligned with the outer edges of the upper and lower plates. In this case, however, there is no means for compensating the size of the outermost display cells. As a result, this method has a problem that the outermost display cells should have a size larger than those of inner display cells.

Figure 2:
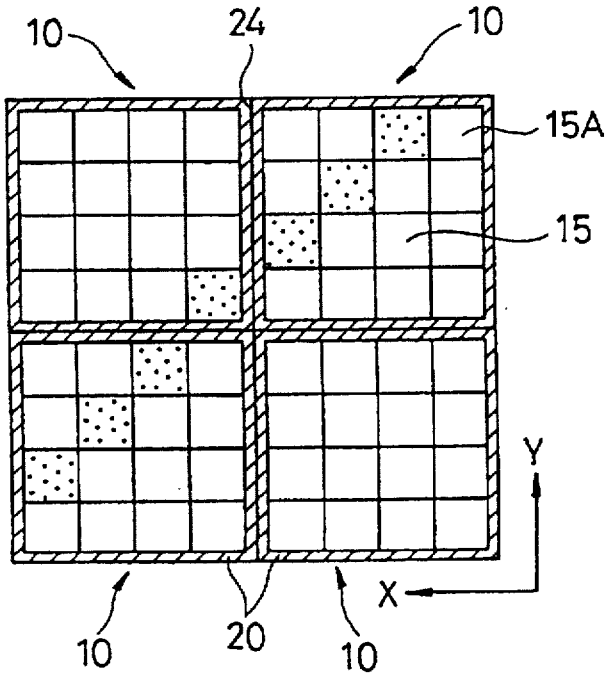
FIG. 2 is a plan view similar to FIG. 1, schematically illustrating a multi-screen constituted by plasma display panels in accordance with the present invention.

FIG. 2 illustrates a multi-screen constituted by connecting a plurality of unit plasma display panels together such that adjacent unit plasma display panels are in contact with each other at their facing edges in accordance with a preferred embodiment of the present invention.

As shown in FIG. 2, each of the unit plasma display panels, which are denoted by the reference numeral 10, has a margin area narrower than that of the conventional plasma display panel 1, in accordance with the embodiment of the present invention. Accordingly, it is possible to avoid the picture discontinuity inevitably generated due to the thickness of the boundary area when an oblique line is displayed such that it extends over adjacent unit plasma display panels 10 as shown in FIG. 2. This results in a great reduction in picture distortion phenomenon, thereby improving the picture quality.

Figure 3:
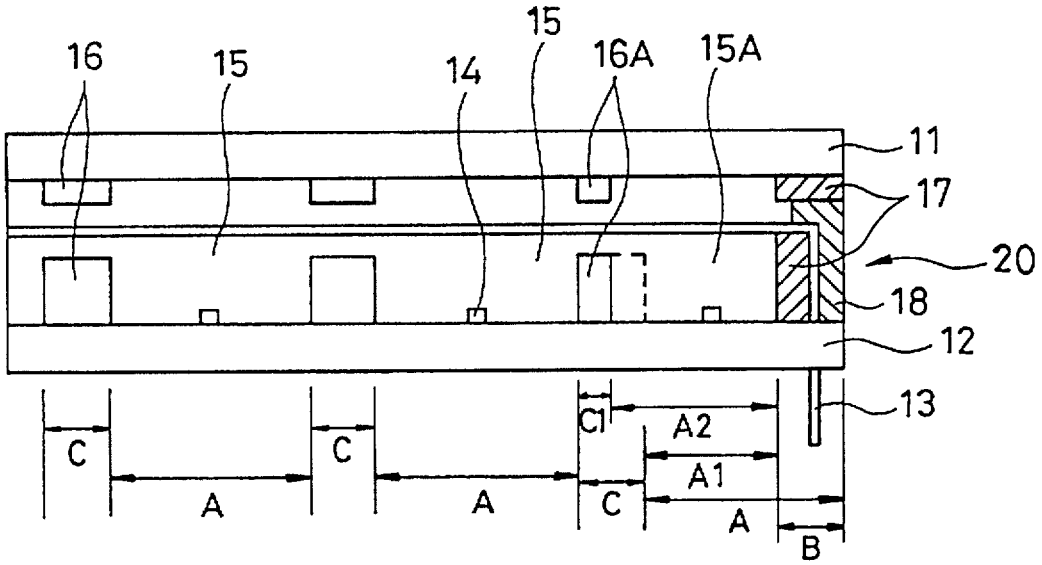
FIG. 3 is a cross-sectional view of the plasma display panel shown in FIG. 2, taken along in an X-axis direction.

FIG. 3 is a cross-sectional view of the plasma display panel 10 shown in FIG. 2, taken along in an X-axis direction. On the other hand, FIG. 4 is a cross-sectional view of the plasma display panel, taken along in a Y-axis direction.

Figure 4:
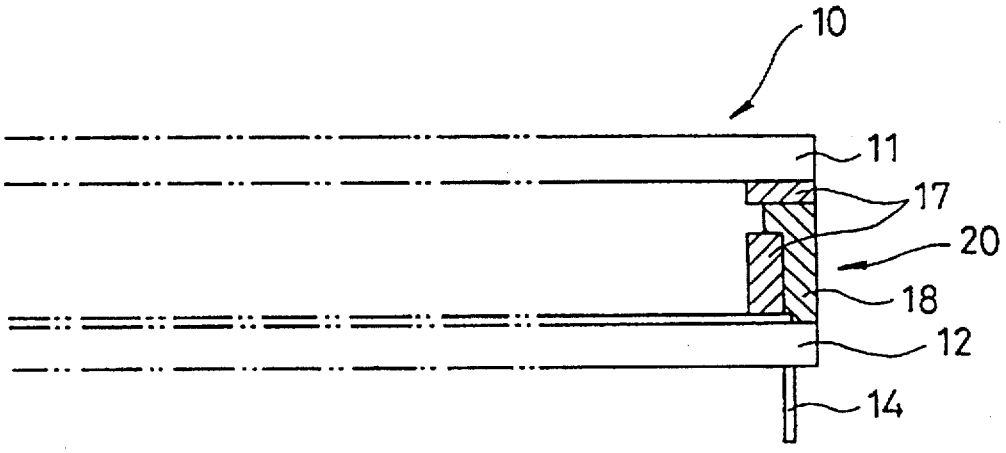
FIG. 4 is a cross-sectional view of the plasma display panel, taken along in a Y-axis direction.

As shown in FIGS. 3 and 4, the plasma display panel 10 basically includes upper and lower plates 11 and 12 having the same size, that is, the same longitudinal and lateral lengths. Between the upper and lower plates 11 and 12, a plurality of spaced cathode electrodes 13 and a plurality of spaced anode electrodes 14 are arranged such that they cross each other. These electrodes 13 and 14 serve to perform a discharge function to display images on corresponding display cells, respectively. The plasma display panel 10 is divided into display cells 15 each constituting a unit pixel by a plurality of first partition members 16. In this arrangement, it should be noted that the display cells 15 defined by the partition members 16 do not include the outermost display cells 15A of the plasma display panel 10. Each of the outermost display cells 15A is defined by a second partition member 16A and side wall members 17 constituting a part of the side wall of the plasma display panel 10. Desirably, the side wall members 17 are formed along the edges of the upper and lower plates 11 and 12 such that they have a small thickness, respectively, using a printing technique.

Preferably, the side wall mender 17 formed on the lower plate 12 is arranged at a place shifted a small distance from the edge of the lower plate 12 inwardly of the plasma display panel 10, as shown in FIG. 3, so that the outer surface bonding portion 20 of the plasma display panel can be vertically aligned with the edges of the upper and lower plates 11 and 12, as will be described hereinafter. The side wall 17 formed on the upper plate 11 is arranged such that its outer surface is vertically aligned with the edge of the upper plate 11.

A bonding member 18 is disposed between the outer surface of the side wall 17 formed on the lower plate 12 and the lower surface of the side wall 17 formed on the upper plate 11. Referring to FIGS. 3 and 4, it can be found that the outer surface of the bonding member 18 is vertically aligned with the outer edges of the upper and lower plates 11 and 12.

All the inner display cells 15 have the same size. On the other hand, the outermost display cells 15A have a size smaller than that of the inner display cells 15 because the side walls 17 formed with a printing technique and the bonding member 18 defining each outermost display cell occupy a certain area of the outermost display cell. Assuming that "A" indicated in FIG. 3 is the width of each inner display cell 15, "A1" the width of each outermost display cell 15A and "B" the width of the bonding part 20 constituted by the side walls 17 and the bonding member 18, respectively, the actual width A1 of the outermost display cell 15A can be expressed as follows: A1=A−B.

In order to make the light-emitting area of the outermost display cell 15A approximate to that of the inner display cells 15 as much as possible, the thickness of the second partition member 16A defining one side surface of the outermost display cell 15A is reduced. That is, the width C1 of the second partition member 16A is smaller than the width C of the first partition members 16 defining each inner display cell 15. In this case, the width reduction of the second partition member 16A is achieved at the portion of second partition member 16A facing the outermost display cell 15A so that only the outermost display cell 15A can increase in area without varying the area of the inner display cell 15 adjacent to the outermost display cell 15A. As the second partition member 16A has a reduced width as mentioned above, the finally obtained width A2 of the outermost display cell 15A becomes larger than the width A1 by a length of "C–C1".

For minimizing the width of the bonding portion of plasma display panel 10 constituted by the side wall members 17 and bonding member 18, the width of each side wall member 17 is smaller than that of the inner partition members 16. It is preferred that the width B of the bonding portion 20 is not more than ⅓ the width A of inner display cell (B≦⅓). In some embodiments the bonding means (e.g. bonding member 18) has a width of not more than ⅓ to ⅕ of the width of the outermost display cell. It is also preferred that the actual width C1 of the second partition member is not more than ½ to ¼ of the width C of the first partition member (C1≦½C).

Although the outermost display cells 15A have been described as having a size smaller than that of the inner display cells 15 in the above-mentioned embodiment, they may have the same size as the inner display cells. In this case, the width A2 of the outermost display cell 15A is identical to the width A of the inner display cell 15. This can be achieved by making the reduced width, "C–C1", of the second partition member 16A identical to the length B of the bonding portion 20 inwardly protruded into the space between the upper and lower plates 11 and 12.

The side walls 17 defining the outermost display cell 15A maintain the cathode electrodes 13 at a constant height. In other words, the cathode electrodes 13 extend through the display cells 15A and 15 while passing over the side wall 17 formed on the lower plate 12. The side walls 17 also serve to prevent the bonding member 18 from being protruded inwardly of the plasma display panel upon pressing the bonding member to bond the upper and lower plates to each other after completing an attachment of the bonding member.

The cathode electrodes 13 and anode electrodes 14 are received in grooves or holes provided at the lower plate 12 so that they are not protruded outwardly of the plasma display panel.

INDUSTRIAL APPLICABILITY

In accordance with the present invention, the bonding portion 20, which is disposed within the display area provided by the upper and lower plates 11 and 12, is constituted by thin side wall members 17 and thin bonding member 18 to have a minimized width. Where a multi-screen is fabricated using plasma display panels including such a bonding portion, accordingly, it involves no or little generation of mosaic pattern due to the connection boundary area 24. Therefore, it is possible to prevent any picture distortion phenomenon upon connecting pictures. Where an oblique line is displayed, it is possible to minimize a degradation in the continuity of the oblique line caused by the width of the connection boundary area because the width of the connection boundary area in the case of the present invention is smaller than that of the conventional plasma display panels.

As apparent from the above description, the present invention provides a plasma display panel having a construction capable of providing a trim edge and maximizing the effective display area. Where plasma display panels having such a construction are used to constitute a multi-screen, it is possible to minimize generation of mosaic pattern, thereby avoiding any picture distortion phenomenon. Accordingly, natural pictures of high quality can be produced.

We claim:

1. A plasma display panel for a multi-screen comprising:

an upper plate and a lower plate;

a plurality of cathode electrodes and anode electrodes arranged so that they are spaced facing each other between the upper and lower plates;

a plurality of inner display cells defined within a display area provided between the upper and lower plates by a plurality of spaced first partition members arranged between the upper and lower plates, respectively, the inner display cells having the same area;

outermost display cells arranged along edges of the upper and lower plates, each of the outermost display cells being defined between side wall means provided along the edges of the upper and lower plates and a second partition member arranged between the upper and lower plates and spaced from the side wall means inwardly of the upper and lower plates, the second partition member having a reduced thickness over that of each first partition member; and bonding means arranged outwardly of the side wall means and provided with an outer surface vertically aligned with the edges of the upper and lower plates, the bonding means being adapted to bond the upper and lower plates to each other.

2. The plasma display panel in accordance with claim 1, wherein each of the outermost display cells has a size smaller than the size of each inner display cell by a size almost identical to the size of the bonding means.

3. The plasma display panel in accordance with claim 2, wherein the side wall means is formed along the edges of the upper and lower plates using a printing method.

4. The plasma display panel in accordance with claim 1, wherein the reduction in thickness of the second partition member is achieved at a portion of the second partition member facing the corresponding outermost display cell.

5. The plasma display panel in accordance with claim 1, wherein the bonding means has a width not more than ⅓ to ⅕ of the width of each outermost display cell.

6. The plasma display panel in accordance with claim 5, wherein the second partition member has a width not more than ½ to ¼ of the thickness of each first partition member.

7. The plasma display panel in accordance with claim 1, wherein each of the outermost display cells has a size identical to the size of each inner display cell.

8. The plasma display panel in accordance with claim 3, wherein the side wall means comprises side wall members independently formed on the upper plate and the lower plate.

9. The plasma display panel in accordance with claim 8, wherein each of the side wall members formed on the lower plate is arranged at a place inwardly shifted a small distance from the edge of the lower plate such that the outer surface of the bonding means is vertically aligned with the edges of the upper and lower plates.

* * * * *